United States Patent [19]

Kidd

[11] 3,998,539

[45] Dec. 21, 1976

[54] ILLUMINATION SYSTEM

[75] Inventor: Wayne L. Kidd, Fairport, N.Y.

[73] Assignee: Xerox Corporation, Stamford, Conn.

[22] Filed: Mar. 10, 1975

[21] Appl. No.: 556,840

[52] U.S. Cl. ..... 355/4; 315/201; 315/324; 355/69; 355/70

[51] Int. Cl.[2] ..... G03G 15/04

[58] Field of Search ..... 355/67, 69, 70, 4, 37, 355/11, 3 R; 315/324, 325, 201, 210; 353/85

[56] References Cited

UNITED STATES PATENTS

| | | | |
|---|---|---|---|
| 2,859,387 | 11/1958 | Ulffers | 315/324 X |
| 3,540,806 | 11/1970 | Starkweather | 355/3 R |
| 3,609,038 | 9/1971 | Koishorn | 355/69 X |
| 3,775,006 | 11/1973 | Hartman et al. | 355/4 |

*Primary Examiner*—Joseph F. Peters, Jr.
*Assistant Examiner*—Kenneth C. Hutchison
*Attorney, Agent, or Firm*—H. Fleischer; C. A. Green; J. J. Ralabate

[57] ABSTRACT

An electrophotographic copying machine having a moving photoconductive member, in which an original document is illuminated by a pair of light sources, which are energized alternately to illuminate the document at a frequency of 240 hertz. This frequency of illumination prevents visible lines in the copy.

7 Claims, 4 Drawing Figures

ILLUMINATION SYSTEM

BACKGROUND OF THE INVENTION

This invention relates generally to electrophotographic printing, and more particularly concerns an illumination system employed therein.

In the process of electrophotographic printing, a photoconductive member is uniformly charged. The charged photoconductive member is irradiated with a light image of an original document. The light image is projected onto the charged photoconductive surface to selectively discharge the charge recording an electrostatic latent image thereon. During development, toner particles are electrostatically attracted to the latent image rendering it visible. Subsequently, the toner powder image is transferred from the photoconductive member to a sheet of support material. The powder image is permanently affixed to the sheet of support material producing a copy of the original document thereon. This process is described in greater detail in U.S. Pat. No. 2,287,691 issued to Carlson in 1942.

In the process of color electrophotographic printing, the optical system forms successive filtered light images of the original document. The filtered or single color light image exposes the charged photoconductive member recording a single color electrostatic latent image thereon. The single color electrostatic latent image is developed with toner particles complementary in color thereto. These toner powder images are transferred from the electrostatic latent image to a sheet of support material. This process is repeated a plurality of cycles with differently colored light images and their respective complementary colored toner particles. Each single color toner powder image is transferred to the sheet of support material in superimposed registration with the prior toner powder image. In this manner, a multi-layered toner powder image is produced on the sheet of support material. This multi-layered toner powder image is then permanently affixed thereto forming a color copy.

In all of the foregoing processes, the function of the exposure or optical system is to illuminate the original document forming a light image thereof which irradiates the charged portion of the photoconductive member. Various techniques have been developed for producing a light image. In one technique, the entire original document is exposed substantially simultaneously. This technique is known as a full frame exposure system. An alternate approach requires the movement of the light source across the original document in synchronism with the motion of the photoconductive member. Thus, a flowing light image is formed which is projected onto the moving photoconductive member. However, in all instances, the light source is cycled on and off at the line frequency. This produces a strobing effect on the resultant copy. Strobing on the copy is a significant problem and manifests itself as a series of developed lines having a spatial frequency equal to the operating frequency of the light source. Generally, strobing will occur with conventional fluorescent lamps. However, this problem is usually overcome by the retention of the phosphor and the required decay time as well as optical de-focusing. In systems using Xenon or gas discharge sources there is frequently little or no retention time. Thus, the light sources cycle on or off at the operating frequency producing copies having a strobing effect.

Accordingly, it is the primary object of the present invention to improve the illumination system of an electrophotographic printing machine by minimizing the effects of strobing on the resultant copy.

SUMMARY OF THE INVENTION

Briefly stated, and in accordance with the present invention, there is provided an apparatus for exposing an original document.

Pursuant to the features of the present invention, the apparatus has a pair of light sources for illuminating the original document. Means are provided for actuating each one of the pair of light sources in a timed relationship. In this manner, alternate light sources are energized and de-energized.

BRIEF DESCRIPTION OF THE DRAWINGS

Other objects and advantages of the present invention will be apparent upon reading the following detailed description and upon reference to the drawings, in which.

While the present invention will hereinafter be described in connection with the preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
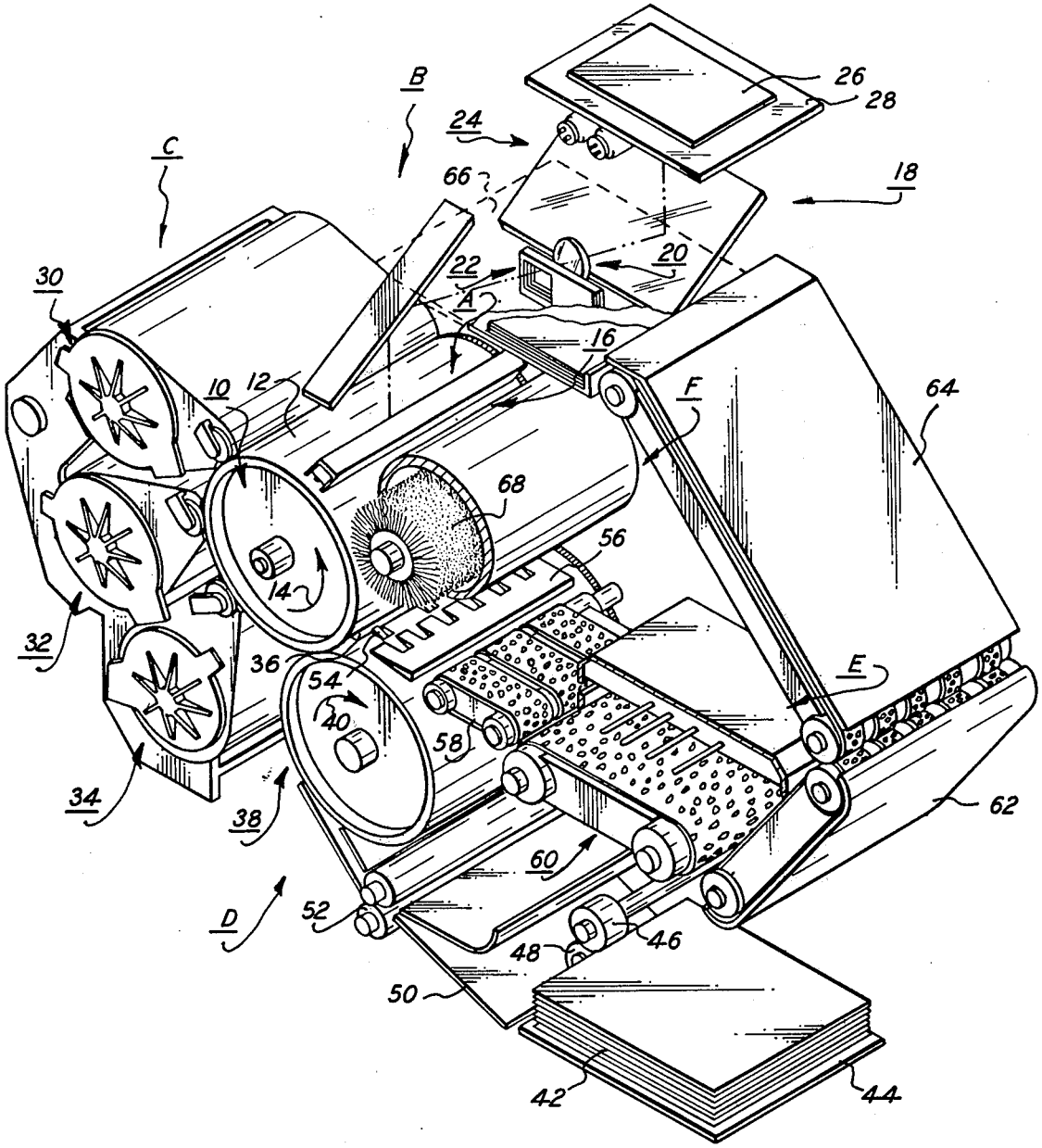
FIG. 1 is a schematic perspective view of an electrophotographic printing machine incorporating the features of the present invention therein.

With continued reference to the drawings wherein like reference numerals have been used throughout to designate like elements, FIG. 1 schematically depicts an electrophotographic printing machine. This printing machine illustrates the various components employed to produce color copies from a multi-colored original document. Although the illumination system of the present invention is particularly well adapted for use in an electrophotographic printing machine, it will become evident from the following description that it is equally well suited for use in a wide variety of printing machines and is not necessarily limited to the particular embodiment shown herein.

The electrophotographic printing machine depicted in FIG. 1 employs a drum 10 having a photoconductive surface 12 secured to and entrained thereabout. Photoconductive surface 12 is preferably made from a selenium alloy such as is described in U.S. Pat. No. 3,655,377 issued to Sechak in 1972.

A series of processing stations are positioned about the periphery of drum 10. Drum 10 rotates in the direction of arrow 14 so as to pass sequentially through each of the processing stations. A timing disc is mounted on the region of one end of drum 10 and is coupled to the logic circuitry of the printing machine. In this way, the sequence of events at each processing station is controlled.

As drum 10 rotates in the direction of arrow 14, initially photoconductive surface 12 moves through charging station A. At charging station A, a corona generating device, indicated generally by the reference numeral 16, charges photoconductive surface 12 to a relatively high substantially uniform level. Corona generating device 16 may be of the type described in U.S. Pat. No. 2,778,946 issued to Mayo in 1957.

After photoconductive surface 12 is charged, drum 10 rotates to exposure station B. Exposure station B includes a moving lens system, generally designated by the reference numeral 20, a color filter, shown generally at 22, and a pair of scan lamps, indicated generally be reference numeral 24. Preferably, lens 20 is a six-element split dagor type of lens as is described in U.S. Pat. No. 3,592,531 issued to McCrobie in 1971, the relevant portions of that disclosure being hereby incorporated into the present application. Filter mechanism 22 includes red, green and blue filters, each filter being moved into the optical light path during its respective machine cycle. A suitable filter mechanism is described in U.S. Pat. No. 3,775,006 issued to Hartman, et al. in 1973. An original document 26 is placed face down upon transparent viewing platen 28. Lamps 24 are located beneath transparent viewing platen 28 to illuminate original document 26. Lamps 24, lens 20 and filter 22 move in a timed relationship with drum 10 to scan successive incremental areas of original document 26 disposed upon platen 28. In this manner, a light image is formed which irradiates the charged portion of photoconductive surface 12. This selectively dissipates the charge thereon recording a single color electrostatic latent image. The appropriate color filter operates on the light image to record an electrostatic latent image on photoconductive surface 12 corresponding to a pre-selected spectral region of the electromagnetic wave spectrum. The detailed structural configuration of lamps 24 and their associate circuitry will be discussed hereinafter with reference to FIGS. 2 and 3.

After the electrostatic latent image is recorded on photoconductive surface 12, drum 10 rotates the latent image to development station C. Development station C has three individual developer units generally indicated by the reference numerals 30, 32 and 34 respectively. Preferably, these developer units are all of the type generally referred to in the art as magnetic brush developer units. A typical magnetic brush developer unit employs a magnetizable developer mix of carrier granules and toner particles. The developer mix is continually brought through a directional flux field to form a brush thereof. Each developer unit includes a developer roll electrically biased to the appropriate potential such that toner particles are attracted from the carrier granules to the area of photoconductive surface 12 having a greater charge thereon. The single color electrostatic latent image recorded on photoconductive surface 12 is developed by bringing the brush of developer mix into contact therewith. Each of the respective developer units contain discretely colored toner particles corresponding to the complement of the spectral region of the wave length of light transmitted through filter 22. Thus, a green filtered electrostatic latent image is rendered visible by depositing green absorbing magenta toner particles thereon. In a similar fashion, blue and red latent images are developed with yellow and cyan toner particles, respectively. A suitable development system is described in U.S. Pat. No. 3,854,449 issued to Draugelis in 1974, the relevant portions of that disclosure being hereby incorporated into the present application.

Drum 10 is next rotated to transfer station D where the toner powder image adhering electrostatically to photoconductive surface 12 is transferred to a sheet of support material 36. Support material 36 may be plain paper, or a sheet of transparent, thermoplastic material. A transfer roll, shown generally at 38, rotates support material 36 in the direction of arrow 40. Transfer roll 38 is electrically biased to a potential of sufficient magnitude and polarity to electrostatically attract toner particles from photoconductive surface 12 to support material 36. U.S. Pat. No. 3,612,677 issued to Langdon et al. in 1972, describes a suitable electrically biased transfer roll, the relevant portions thereof being hereby incorporated into the present application. Transfer roll 36 rotates in synchronism with drum 10, i.e. at the same tangential velocity. In this way, successive toner powder images may be transferred to support material 36 in superimposed registration with one another. One toner powder image is transferred for each machine cycle, a complete multi-color copy being formed after three machine cycles.

Prior to continuing with the remaining processing stations, the sheet feeding path will be briefly discussed. A stack of sheets of support material 42 are disposed upon tray 44. Feed roll 46, cooperating with retard roll 48, advances and separates successive uppermost sheets from stack 42. As feed roll 46 advances the sheet of support material, it enters into chute 50. Chute 50 guides the advancing sheet into the nip between register rolls 52. Register rolls 52 continue to forward support material 36 in synchronism with the rotation of transfer roll 38. Gripper fingers 54 mounted in transfer roll 38 secure the advancing sheet thereto. After the requisite number of toner powder images have been transferred to support material 36 (in this case three), gripper fingers 54 space support material 36 from transfer roll 38. This permits stripper bar 56 to be interposed therebetween separating support material 36 from transfer roll 38. After support material 36 is separate from transfer roll 38, endless belt conveyor 58 advances it to fixing station E.

A fixing station E, a suitable fuser, indicated generally by the reference numeral 60, heats the multi-layered toner powder image permanently affixing it to support material 36. A suitable fusing device is described in U.S. Pat. No. 3,826,892 issued to Draugelis et al. in 1974, the relevant portions thereof being hereby incorporated into the present application. After the multi-layered toner powder image is affixed to support material 36, endless belt conveyors 62 and 64 advance support material 36 to catch tray 66. Catch tray 66 is positioned such that the machine operator may readily remove the final multi-colored copy from the printing machine.

Returning now to the remaining processing station located about the periphery of drum 10. After passing through the transfer station D, the residual toner particles are advanced to cleaning station E. Invariably residual toner particles remain on photoconductive surface 12 after the transfer of the powder image therefrom to support material 36. These residual toner particles are removed from photoconductive surface 12 as it passes through cleaning station F. At cleaning station F, a cleaning corona generating device (not shown) neutralizes the electrostatic charge remaining on the residual toner particles and photoconductive surface 12. The neutralized toner particles are then removed from photoconductive surface 12 by rotatably mounted brush 68 in contact therewith. A suitable brush cleaning device is described in U.S. Pat. No. 3,590,412 issued to Gerbasi in 1971.

It is believed that the foregoing description is sufficient for purposes of the present application to illustrate the general operation of an electrophotographic printing machine embodying the teachings of the present invention therein.

Figure 2:
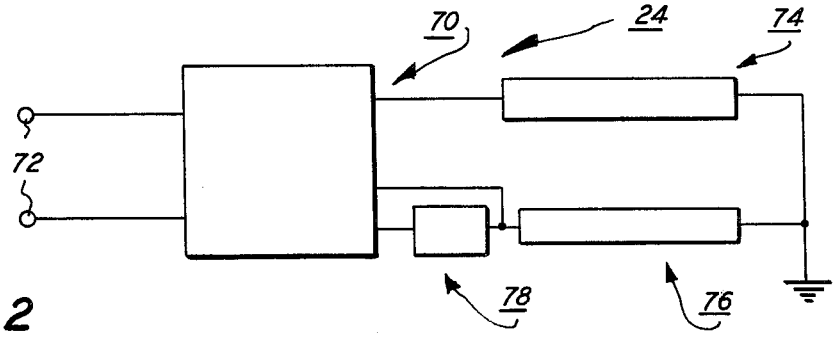
FIG. 2 is a block diagram of the illumination system employed in the FIG. 1 printing machine.

Referring now to FIG. 2, illumination system 24 is depicted there at in greater detail. Power supply 70 is energized at terminals 72 by an AC line voltage of 120 volts at 60 hertz. Power supply 70 provides a high voltage DC output to excite lamps 74 and 76. Power supply 70 also furnishes 9.8 volts DC to excite time delay circuit 78. Lamps 74 and 76 are both Xenon lamps. Lamp 74 is triggered or energized every 8.32 milliseconds. Similarly, lamp 76 is also triggered or energized every 8.32 milliseconds. However, when lamp 74 is energized lamp 76 is de-energized, and when lamp 76 is energized lamp 74 is de-energized. Thus, the lamps are actuated in a timed relationship with one another. Lamp 76 being energized 4.1 milliseconds after lamp 74 is energized. Circuit 78 performs the requisite time delay. The triggering of lamp 76 is delayed 4.1 milliseconds after the triggering of lamp 74. In this way, both lamps 74 and 76 are energized at a frequency of 120 hertz. However, the combined illumination profile has a frequency of 240 hertz, i.e. the sum of the frequencies of both lamps.

Figure 3:
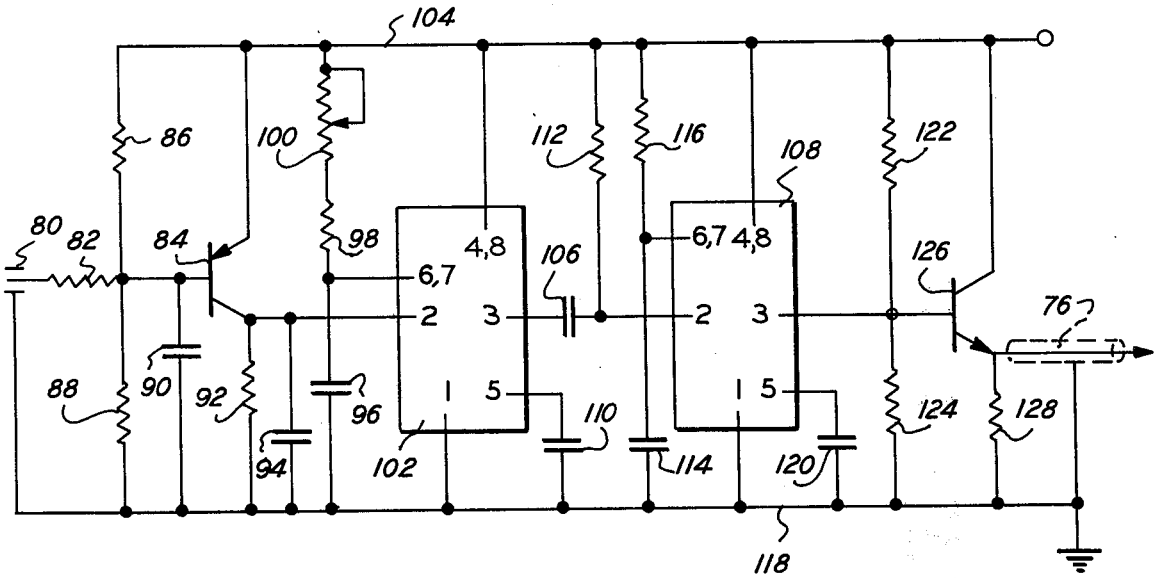
FIG. 3 is a circuit diagram of the time delay circuit utilized in the FIG. 2 illumination system.

Referring now to FIG. 3, there is shown the detailed circuitry for time delay 78. Voltage source 70 excites time delay circuit 78 at 9.8 volts DC. Coaxial cable 80 is provided for noise suppression. The 470 ohm resistor 82 is provided to impendence match the input stage of transistor 84. Preferably, transistor 84 is Model No. 2N390 manufactured by the Texas Instruments Co. A voltage divider network having a 1000 ohm resistor 86 and 10,000 ohm resistor 88 is necessary to properly bias transistor 84. Capacitor 90 is electrically connected in parallel with resistor 88 and has a capacitance of 0.002 microfarads for noise suppression. Resistor 92 has a resistance of 820 ohms and provides loading for transistor 84. A 500 picofarad capacitor 94 is provided for noise suppression. A storage capacitor 96 having a capacitance of 0.47 microfarads is connected in series with a 470 ohm resistor 98 and a 10,000 ohm variable resistor 100. This circuit provides storage capacitance to establish the timing of flip-flop 102. In essence, it is an RC circuit which acts as the timing network. Flip-flop 102 introduces a 4.1 millisecond delay in triggering lamp 76. Preferably, flip-flop 102 is Model No. 555 manufactured by the Texas Instruments Co. As shown in FIG. 3, the output from transistor 84 is connected to pin 2 of flip-flop 102 whereas the output from resistor 98 and capacitor 96 is connected to pins 6 and 7 of flip-flop 102. Pins 4 and 8 of flip-flop 102 are tied together and connected to line 104. Capacitor 106 couples flip-flop 102 with flip-flop 108 and has a capacitance of 0.001 micro-arads. A 0.01 microfarad capacitor 110 provides a ground reference for pin 5 of flip-flop 102. Resistor 112, capacitor 114 and resistor 116 provide biasing for flip-flop 108. Resistor 116 is connected to pins 6 and 7 of flip-flop 108 and line 104. Capacitor 114 is connected to pins 6 and 7 of flip-flop 108 and line 118. Resistor 112 is connected between capacitor 106 and pin 2 of flip-flop 108. In addition, resistor 112 has the other terminal thereof connected to line 104. Thus, resistor 112, capacitor 114 and resistor 116 provide a 4.1 millisecond set point for flip-flop 108. Capacitor 120 connects pin 5 of flip-flop 108 to ground providing a ground reference. By way of example, resistor 112 has a resistance of 27,000 ohms, resistor 116 has a resistance of 3300 ohms, capacitor 114 has a capacitance of 0.001 microfarads and capacitor 120 has a capacitance of 0.01 microfarads. Resistor 122 and resistor 124 are connected to pin 3 of flip-flop 108. Resistor 122 is also connected to line 104, while resistor 124 is connected to line 118. Preferably, resistor 122 has a resistance of 10,000 ohms whereas resistor 124 has a resistance of 1,000 ohms. Resistors 122, 124, and 128 are connected to the base of transistor 126. Resistor 128 has a value of 2,200 ohms. Resistor 128 is also connected to line 118. Preferably, transistor 126 is Model No. 2N3904 manufactured by the Texas Instruments Company. The output from transistor 126 triggers lamp 76 a pre-selected time interval (4.1 milliseconds) after lamp 74 has been triggered. This introduces a time delay producing a DC wave having a combined frequency of 240 hertz. It should be noted that the lamp 76 is also connected to lamp 74, both being grounded.

Figure 4:
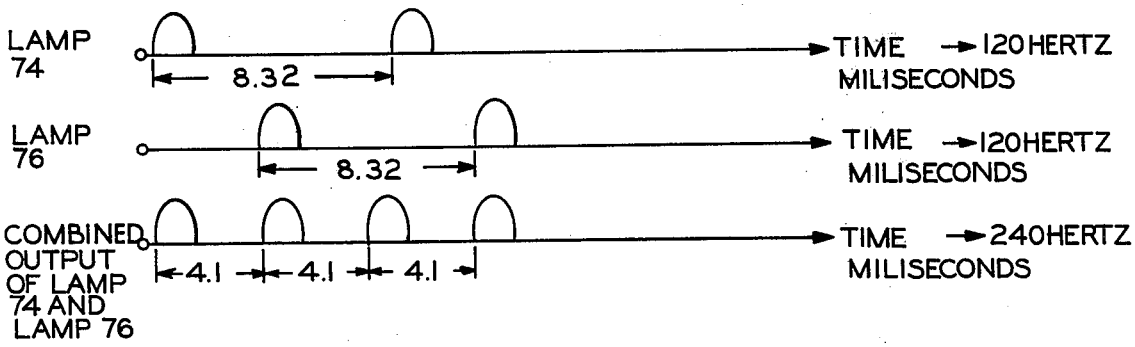
FIG. 4 is a timing diagram depicting the light pulse train for the FIG. 2 illumination system.

Turning now to FIG. 4, there is shown a timing diagram for lamps 74 and 76. As shown thereat, lamp 74 is energized at time $t=0$ and every 8.32 milliseconds thereafter. In this way, lamp 74 is triggered at a frequency of 120 hertz. Similarly, lamp 76 is also triggered at a frequency of 120 hertz displaced in time 4.1 milliseconds after the triggering of lamp 74. Thus, at time $t=0$ lamp 74 is energized whereas lamp 76 is de-energized. However, at time $t=4.1$ milliseconds lamp 74 is de-energized and lamp 76 is energized. In this way, the combined output from lamps 74 and 76 illuminates the original document at a frequency of 240 hertz, the time delay between each repetitive wave being 4.1 milliseconds.

In recapitulation, it is evident that the illumination system utilized in the electrophotographic printing machine hereinbefore described acts to prevent strobing on the resultant copy. The foregoing is achieved by producing a sufficiently high triggering rate so that the strobing effect is not visible to the human eye. This is achieved by energizing each lamp out of phase with the other lamp. In this way, at any one given time only one of the light sources is energized, the other light source being de-energized. However, the total illumination rate is the sum of the energization rates of each light source individually. This pulse rate is sufficiently high to prevent the human eye from seeing strobing or lines in the resultant copy.

While the illumination system of the present invention has been described as being employed in a multicolor electrophotographic printing machine utilizing dry or powder toner, it is obvious to one skilled in the art that the invention is not necessarily so limited in its use. By way of example, the illumination system may be employed in black or white electrophotographic printing machines or one using liquid development. A printing machine using liquid development is described in U.S. Pat. No. 3,008,115 issued to Gundlach in 1962. Similarly, the optical system may be utilized in a photoelectrophoretic imaging system. A polychromatic photoelectrophoretic imaging system is described in U.S. Pat. No. 3,338,488 issued to Tulagin in 1968.

It is therefore, apparent that there has been provided in accordance with the present invention, an illumination system that fully satisfies the objects, aims and advantages hereinbefore set forth. While the system has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. An electrophotographic printing machine for reproducing an original document, including:

a photoconductive member;

means for charging said photoconductive member to a substantially uniform potential; and means for exposing the charged portion of said photoconductive member to record thereon an electrostatic latent image corresponding to the original document, said exposing means comprising a pair of light sources for illuminating the original document and means for periodically energizing each of the pair of light sources in a timed relationship with one another so that alternately one of the pair of light sources is energized with the other of the pair of light sources being de-energized, wherein each of the pair of light sources is energized at an equal rate with one of the pair of light sources being energized at a pre-selected time interval after the other of the pair of light sources.

2. A printing machine as recited in claim 1, further including:

means for developing the electrostatic latent image recorded on said photoconductive member with charged particles:

means for transferring the charged particles from said photoconductive member to a sheet of support material; and means for permanently affixing the charged particles to the sheet of support material in image configuration forming a copy of the orginal document.

3. A printing machine as recited in claim 2, wherein the energizing means of said exposing means includes:

a voltage source coupled to the pair of light sources; and a time delay circuit interposed between the voltage source and one of the pair of light sources.

4. A printing machine as recited in claim 3, wherein said exposing means includes a lens positioned in the optical light path for receiving light rays transmitted from the original document to form a light image thereof.

5. A printing machine as recited in claim 4, wherein said exposing means includes means for filtering successive light images to form successive differently colored single color light images which irradiate the charged portions of said photoconductive member recording single color electrostatic latent images thereon.

6. A printing machine as recited in claim 5, wherein:

said developing means deposits charged particles complimentary in color to the color of the single color light image on the corresponding single color electrostatic latent image;

said transferring means transfers successive differently colored charged particles from said photoconductive member to a sheet of support material in superimposed registration with one another forming a multi-color powder image thereon; and said fixing means permanently affixes the multi-colored charged particles to the sheet of support material in image configuration forming a color copy of the original document.

7. A printing machine as recited in claim 6, wherein each one of the pair of light sources of said exposing means is a Xenon lamp.

* * * * *